US012474110B2

(12) United States Patent
Chhajed et al.

(10) Patent No.: US 12,474,110 B2
(45) Date of Patent: Nov. 18, 2025

(54) TUBE ROUTING SYSTEM FOR A COOLING APPLIANCE

(71) Applicant: Whirlpool Corporation, Benton Harbor, MI (US)

(72) Inventors: Rahul Subhash Chhajed, Pune (IN); Rahul Sadanand Kumbhare, Gadchiroli (IN); Abinash Sarma, Tinsukia (IN)

(73) Assignee: Whirlpool Corporation, Benton Harbor, MI (US)

( * ) Notice: Subject to any disclaimer, the term of this patent is extended or adjusted under 35 U.S.C. 154(b) by 327 days.

(21) Appl. No.: 18/149,259

(22) Filed: Jan. 3, 2023

(65) Prior Publication Data

US 2024/0219101 A1 Jul. 4, 2024

(51) Int. Cl.
*F25D 23/00* (2006.01)
*F25D 17/02* (2006.01)

(52) U.S. Cl.
CPC ..... *F25D 23/006* (2013.01); *F25D 17/02* (2013.01); *F25D 2201/14* (2013.01); *F25D 2400/40* (2013.01)

(58) Field of Classification Search
CPC .... F25D 23/006; F25D 17/02; F25D 2201/14; F25D 2400/40; F25D 23/061; F25D 23/068; F25D 23/067; F25D 23/065
See application file for complete search history.

(56) References Cited

U.S. PATENT DOCUMENTS

| | | | | |
|---|---|---|---|---|
| 4,346,568 | A * | 8/1982 | Perrone | F24F 1/029 62/298 |
| 9,377,227 | B2 | 6/2016 | Jung et al. | |
| 9,599,391 | B2 | 3/2017 | Gultekin et al. | |
| 10,605,520 | B1 | 3/2020 | Ekshinge et al. | |
| 11,175,089 | B2 * | 11/2021 | Marinello | F25D 23/061 |
| 2021/0092865 | A1 | 3/2021 | Gentile et al. | |

FOREIGN PATENT DOCUMENTS

| | | | |
|---|---|---|---|
| CN | 100549603 | C | 10/2009 |
| CN | 102313430 | A | 1/2012 |
| CN | 110411112 | A | 11/2019 |
| DE | 202008007363 | U1 | 8/2008 |
| EP | 2596300 | B1 | 9/2015 |

(Continued)

*Primary Examiner* — Miguel A Diaz
(74) *Attorney, Agent, or Firm* — Price Heneveld LLP

(57) ABSTRACT

A cooling appliance includes a body defining a vacuum-insulated chamber. A cooling device is configured to regulate a temperature in the vacuum-insulated chamber. A partition is adjacent to the vacuum-insulated chamber and a compartment is spaced from the vacuum-insulated chamber by the partition. A compressor and a condenser are located in the compartment and at least one coolant tube is in fluid communication with the compressor, the condenser, and the cooling device. A conduit provides power to and extends between the compressor and the condenser. A shroud bracket is located between the compressor and the condenser and defines at least one slot that retains the at least one coolant tube. A drainage routing tube extends from the cooling device to a drain tube mount and the drain tube mount includes a retention feature connected to a drainage receptacle.

16 Claims, 7 Drawing Sheets

(56) References Cited

FOREIGN PATENT DOCUMENTS

| | | | |
|---|---|---|---|
| EP | 3695706 | A1 | 8/2020 |
| EP | 3872429 | A1 | 9/2021 |
| JP | 2003075057 | A | 3/2003 |
| WO | 2009019268 | A2 | 2/2009 |
| WO | 2012059337 | A2 | 5/2012 |
| WO | 2022143909 | A1 | 7/2022 |

* cited by examiner

TUBE ROUTING SYSTEM FOR A COOLING APPLIANCE

BACKGROUND OF THE DISCLOSURE

The present disclosure generally relates to a tube routing system for a cooling appliance, and more specifically, to a tube routing system for refrigerant tubes for a cooling appliance.

SUMMARY OF THE DISCLOSURE

According to one aspect of the present disclosure, a cooling appliance includes a body defining a vacuum-insulated chamber. A cooling device is configured to regulate a temperature in the vacuum-insulated chamber. A partition is adjacent to the vacuum-insulated chamber and a compartment is spaced from the vacuum-insulated chamber by the partition. A compressor and a condenser are located in the compartment and at least one coolant tube is in fluid communication with the compressor and the condenser. A conduit provides power to and extends between the compressor, the condenser, and the cooling device. A shroud bracket is located between the compressor and the condenser and defines at least one slot that retains the at least one coolant tube.

According to another aspect of the present disclosure, a cooling appliance includes a body defining a vacuum-insulated chamber. A cooling device is configured to regulate a temperature in the vacuum-insulated chamber. A partition is adjacent to the vacuum-insulated chamber and a compartment is spaced from the vacuum-insulated chamber by the partition. A compressor and a condenser are located in the compartment and at least one coolant tube is in fluid communication with the compressor, the condenser, and the cooling device. A conduit provides power to and extends between the compressor and the condenser. A drainage routing tube extends from the cooling device to a drain tube mount and the drain tube mount includes a retention feature connected to a drainage receptacle.

According to yet another aspect of the present disclosure, a cooling appliance includes a body defining a vacuum-insulated chamber. A cooling device is configured to regulate a temperature in the vacuum-insulated chamber. A partition is adjacent to the vacuum-insulated chamber and a compartment is spaced from the vacuum-insulated chamber by the partition. A compressor and a condenser are located in the compartment and at least one coolant tube is in fluid communication with the compressor, the condenser, and the cooling device. A conduit provides power to and extends between the compressor and the condenser. A shroud bracket is located between the compressor and the condenser and defines at least one slot that retains the at least one coolant tube. A drainage routing tube extends from the cooling device to a drain tube mount and the drain tube mount includes a retention feature connected to a drainage receptacle.

These and other features, advantages, and objects of the present disclosure will be further understood and appreciated by those skilled in the art by reference to the following specification, claims, and appended drawings.

Figure 1:
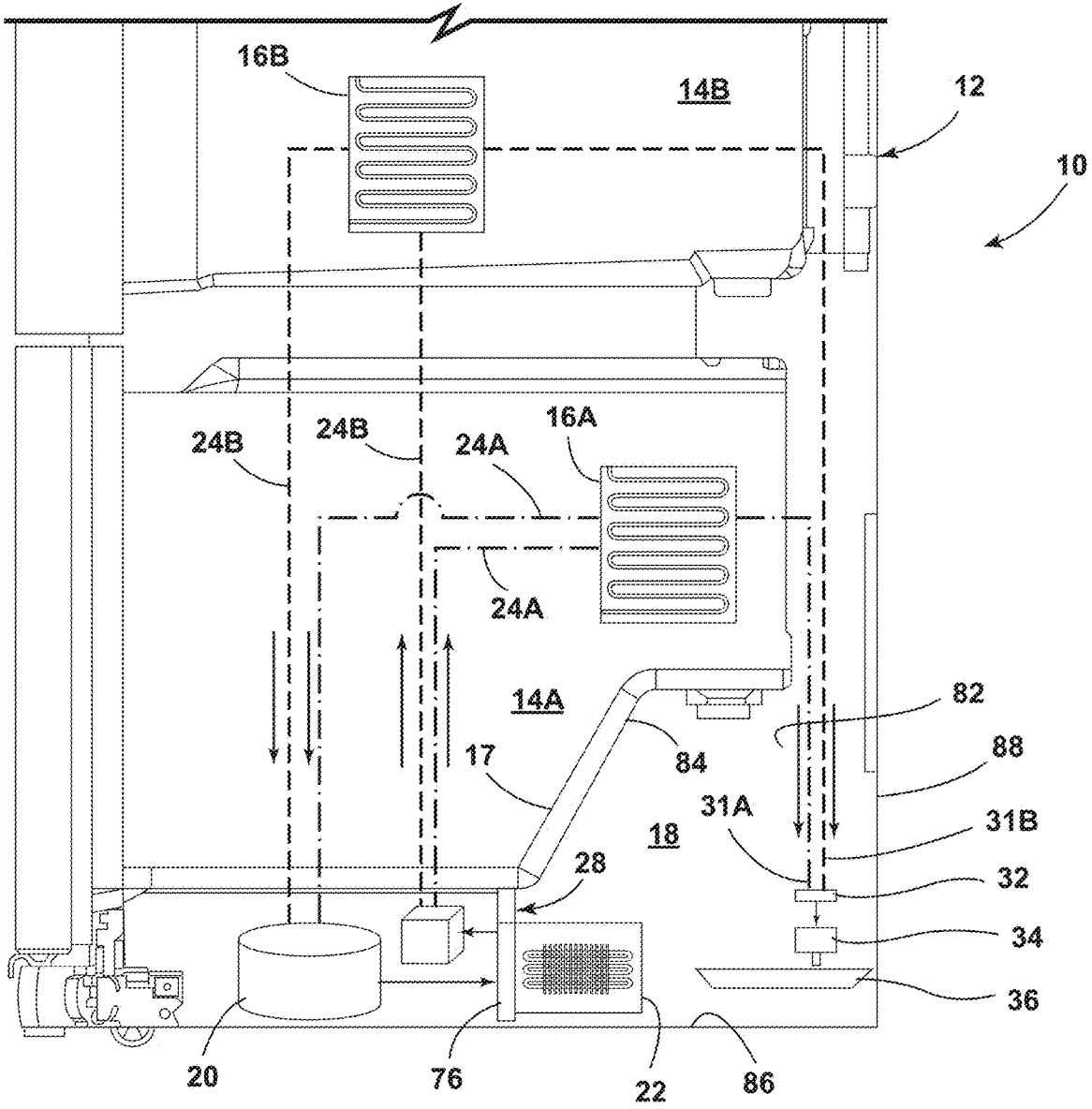
FIG. 1 is a side schematic view of a cooling appliance with a tube routing system in accordance with an aspect of the disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a tube routing system for refrigerant tubes for a cooling appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-9, reference numeral 10 generally designates a cooling appliance that includes a body 12 defining a vacuum-insulated chamber 14A, 14B (e.g., a freezer vacuum-insulated chamber 14A and a refrigeration vacuum-insulated chamber 14B). A cooling device 16A, 16B (e.g., a first evaporator 16A associated with the freezer vacuum-insulated chamber 14A and a second evaporator 16B associated with the refrigeration vacuum-insulated chamber 14B) is configured to regulate a temperature in the vacuum-insulated chamber 14A, 14B. A partition 17 is adjacent to the vacuum-insulated chamber 14A, 14B and a compartment 18 is spaced from the vacuum-insulated chamber 14A, 14B by the partition 17. A compressor 20 and a condenser 22 are located in the compartment 18 and at least one coolant tube 24A, 24B (e.g., a first cooling tube 24A connected to the first evaporator 16A and a second cooling tube 24B connected to the second evaporator 16B) is in fluid communication with the compressor 20, the condenser 22, and the cooling device 16A, 16B. A conduit 26 (FIGS. 2, 6, and 7) provides power to and extends between the compressor 20, the condenser 22, and the cooling device 16A, 16B. A shroud bracket 28 is located between the compressor 20 and the condenser 22 and defines at least one slot 30 (FIGS. 7-9) that retains the at least one coolant tube 24A, 24B.

Figure 2:
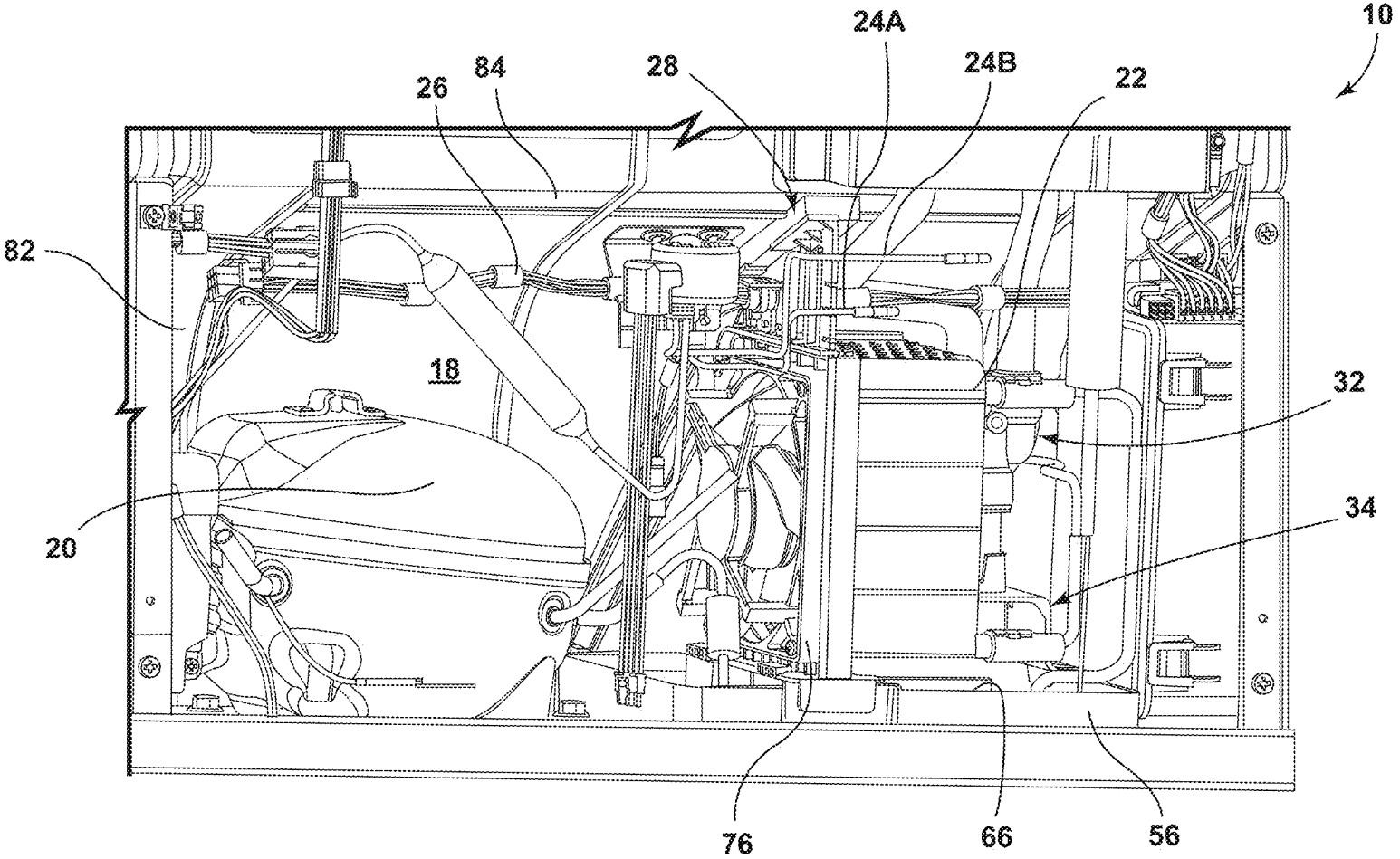
FIG. 2 is a rear perspective view of a cooling appliance that includes a compartment with a tube routing system in accordance with an aspect of the disclosure.
Figure 4:
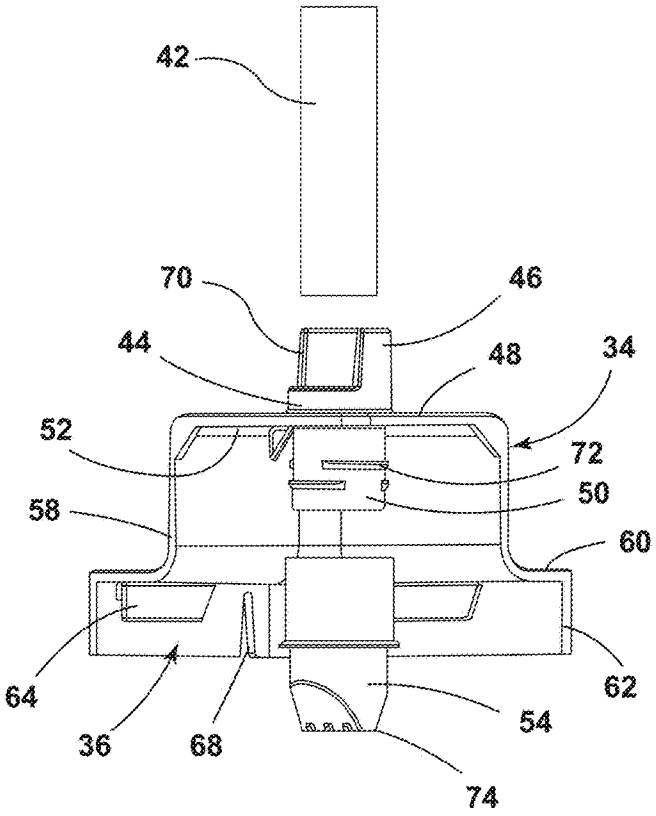
FIG. 4 is a rear perspective view of a drain tube mount in a disassembled condition in accordance with an aspect of the disclosure.
Figure 3:
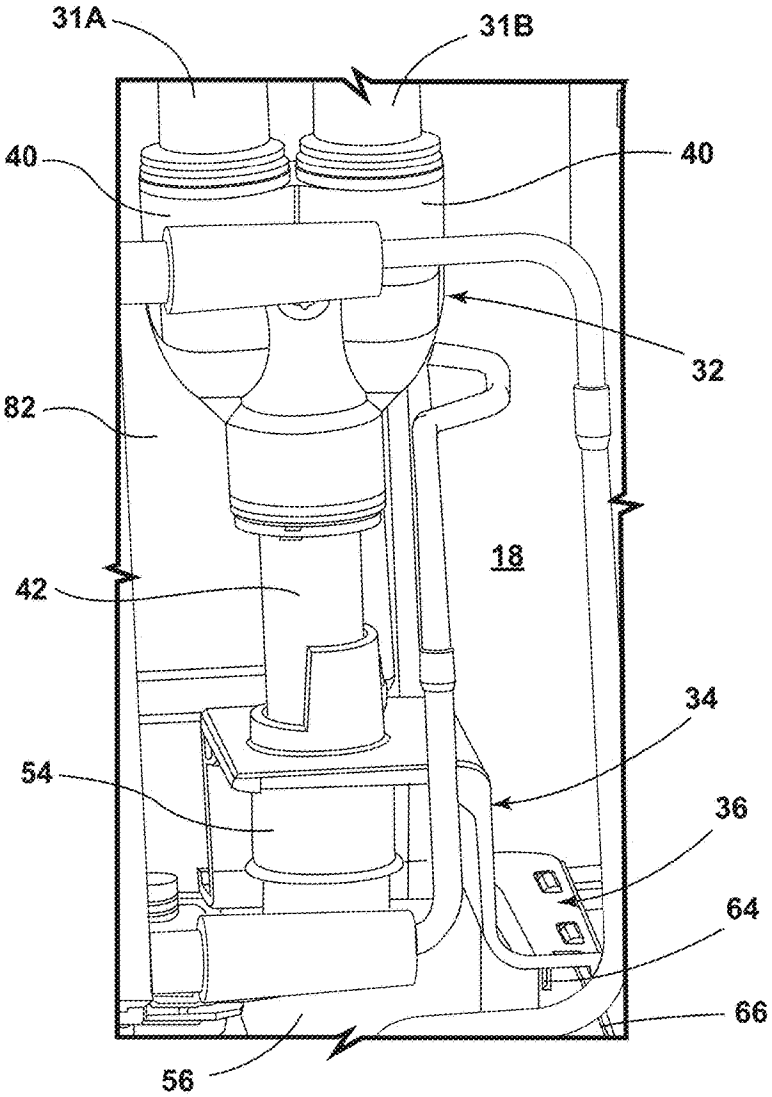
FIG. 3 is a front perspective view of a drain tube mount for a cooling appliance in accordance with an aspect of the disclosure.

With reference now to FIGS. 2-4, a first drainage routing tube 31A extends from the first evaporator 16A and a second drainage routing tube 31B extends from the second evaporator 16B. Each drainage routing tube 31A, 31B terminates at a junction 32 and a drain tube mount 34 is in fluid communication with the junction 32 and defines a retention feature 36 (FIGS. 3 and 4) in press-fit engagement within an interior of the compartment 18. More particularly, the junction 32 may include a pair of inlet ports 40 connected to the first drainage routing tube 31A and the second drainage routing tube 31B that each are in fluid communication with an outlet tube 42 (FIG. 3). The drain tube mount 34 defines a sleeve 44 including a top portion 46 extending from a top surface 48 of the drain tube mount 34 and a bottom portion 50 extending from a bottom surface 52 of the drain tube mount 34 (FIG. 4). The top portion 46 is in fluid communication with the outlet tube 42 and the bottom portion 50 is in fluid communication with a drainage release tube 54 disposed over a drainage receptacle 56. The drainage receptacle 56 is located adjacent to the drain tube mount 34 and captures drainage from the first coolant tube 24A and the second coolant tube 24B such that the drainage receptacle 56 can be emptied for disposal of drainage.

With continued reference now to FIGS. 2-4, the drain tube mount 34 includes a cup 58 defining the top surface 48 and the bottom surface 52. The cup 58 includes a stepped region 60 defining the retention feature 36. The stepped region 60 extends from the cup 58 to a flange 62. The retention feature 36 includes a plurality of tabs 64 and extends from the bottom surface 52. The drainage receptacle 56 may include a rim 66 (FIG. 2) that extends upwardly in an opposite direction of the tabs 64 and flange 62. During assembly, the drain mount 34 is pressed against the drainage receptacle 56 until the rim 66 is disposed between the tabs 64 and the flange 62. In this manner, the drain tube mount 34 is securely connected to the drainage receptacle 56 to selectively remove and reconnect for servicing. The stepped region 60 and flange 62 may be L-shaped in order to connect to a corner of the drainage receptacle 56.

With reference now to FIGS. 3 and 4, the flange 62 may define a pressure relief channel 68 that facilitates deformation of the flange 62 during connection to the drainage receptacle 56. A side of the drain tube mount 34 opposite the stepped region 60 may be open. The top portion 46 of the sleeve 44 includes a cleft 70 that facilitates insertion of the outlet tube 42 from the junction 32. The bottom portion 50 of the sleeve 44 includes one or more gripping projections 72 that facilitate connection of the drainage release tube 54. The drainage release tube 54 extends from the bottom portion 50 of the sleeve 44 to a drainage nozzle 74. The drainage nozzle 74 may include a duckbill-type shape opening.

Figure 5:
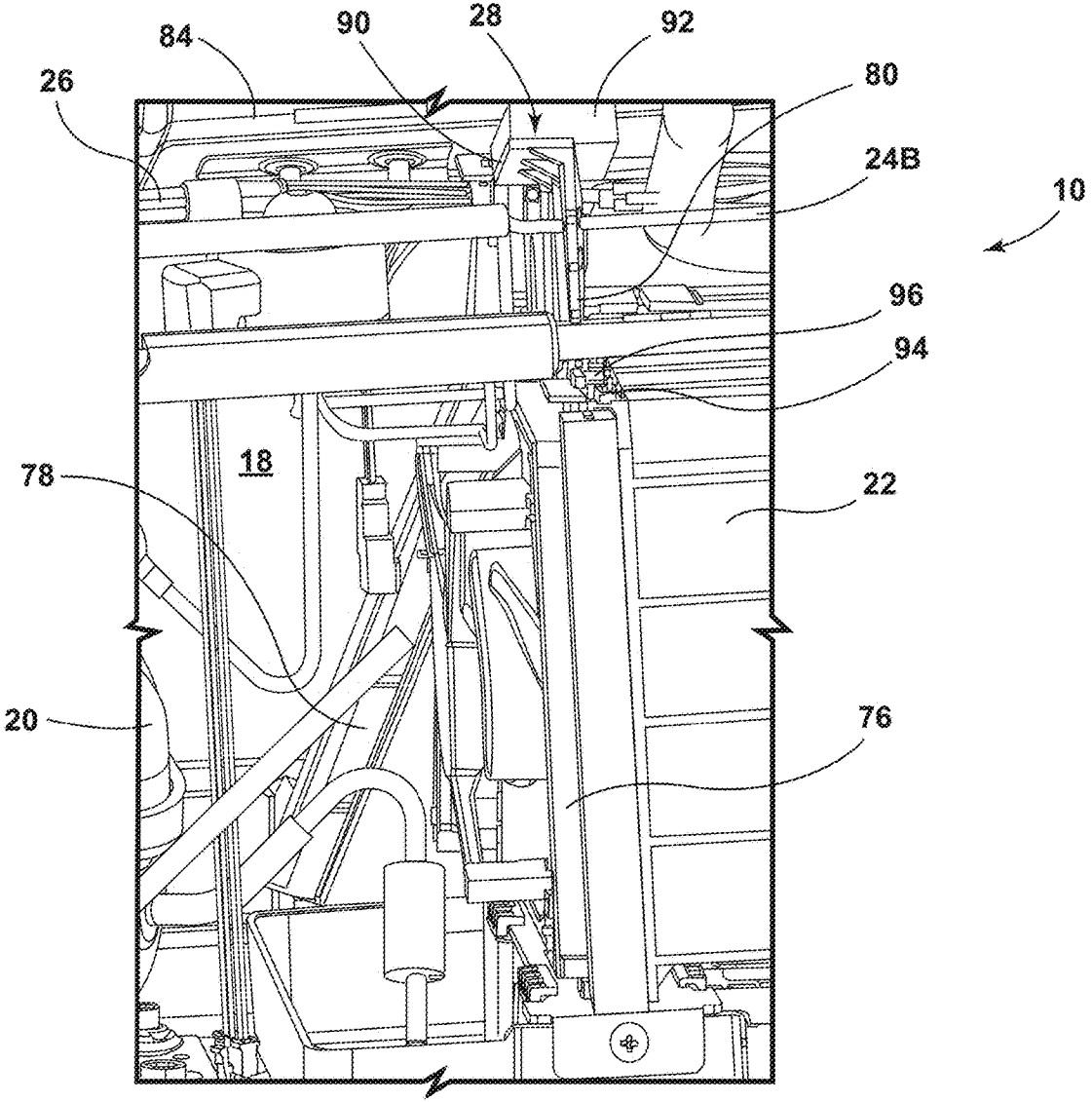
FIG. 5 is an enlarged rear perspective view of a cooling appliance that includes a shroud bracket in accordance with an aspect of the disclosure.
Figure 7:
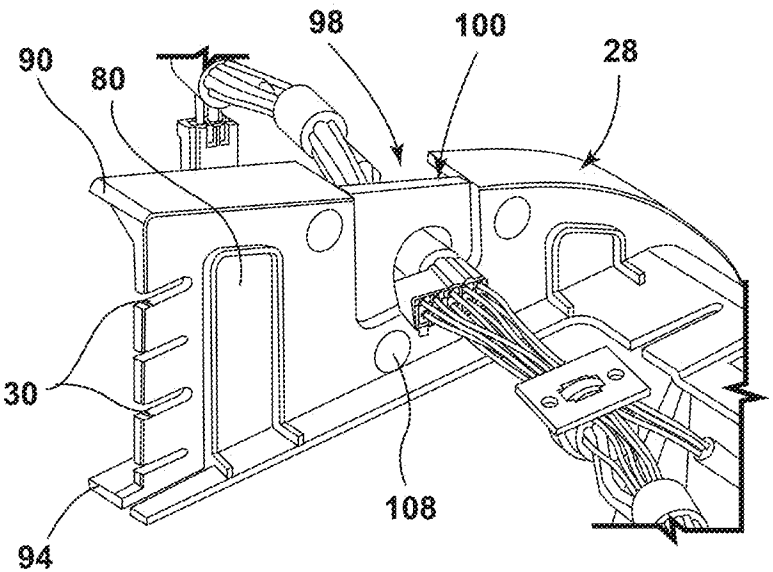
FIG. 7 is an upper perspective view of a first side of a shroud bracket in accordance with an aspect of the disclosure.
Figure 6:
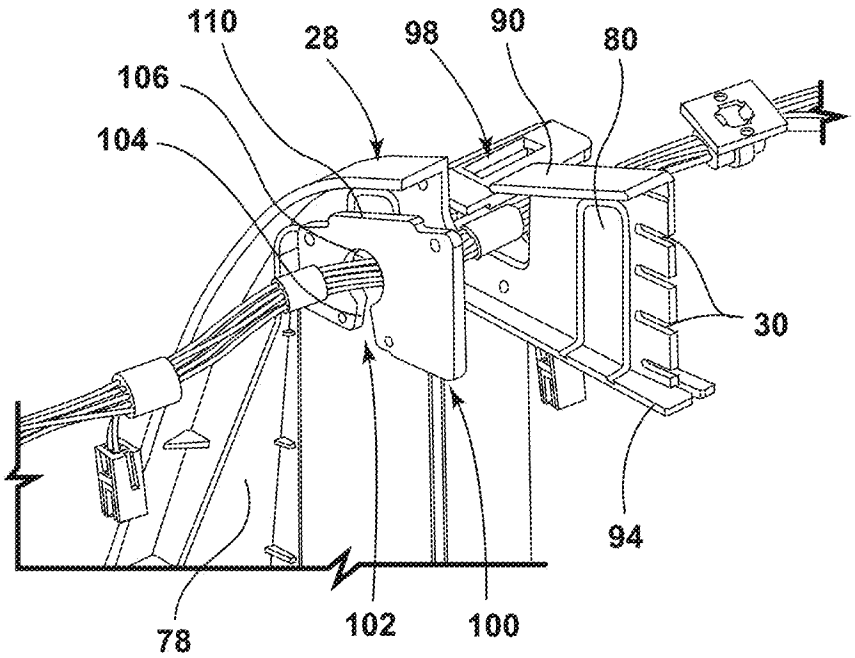
FIG. 6 is an upper perspective view of a first side of a shroud bracket in accordance with an aspect of the disclosure.

With reference now to FIGS. 5-7, the shroud bracket 28 is located on a fan 76 between the compressor 20 and the condenser 22 and includes a trunk portion 78 and a head portion 80. The compartment 18 is defined by an interior sidewall 82, an interior ceiling 84, an interior floor 86, and a door 88 (FIGS. 1 and 2) that provides access to the compartment 18. The shroud bracket 28 wraps around a portion of the fan 76 to divide the compartment 18 between the compressor 20 and the condenser 22. More particularly, the shroud bracket 28 includes an outer widened portion 90 extending around an outer perimeter. A sealing element 92 is sandwiched between the outer widened portion 90, the interior sidewall 82, and the interior ceiling 84. The sealing element 92 may be formed of a flexible material that is deformed (e.g., via squeezing). The sealing element 92 may be sandwiched between the trunk portion 78 and the interior sidewall 82 and between the head portion 80 and the interior ceiling 84. The shroud bracket 28 further includes an inner widened portion 94 that contacts an outer perimeter of the fan 76. The inner widened portion 94 may connect to the outer perimeter of the fan 76 via a clip 96 (FIG. 5).

With reference now to FIGS. 6 and 7, the shroud bracket 28 defines a bay 98 that retains the conduit 26. The bay 98 may extend through the outer widened portion 90. An air separator plate 100 is connected to the shroud bracket 28 over an outer perimeter of the bay 98 to improve cooling performance of the cooling appliance 10 by separating air from the side of the compressor 20 and air from the side of the condenser 22. The air separator plate 100 defines an opening 102 smaller than the bay 98 and the conduit 26 extends through the opening 102. The opening 102 includes a slit portion 104 to facilitate insertion of the conduit 26 and an aperture portion 106 that retains the conduit 26. The shroud bracket 28 may be formed of a first material and the air separator plate 100 may be formed of a second material that is more flexible than the first material. The air separator plate 100 may connect to the should bracket 28 by fasteners 108, such as Christmas-tree type fasteners that can be secured without the use of tools. The air separator plate 100 may define a central projection 110 along a top perimeter thereof that mates with the bay 98 adjacent to the outer widened portion 90. As such, the top perimeter of the air separator plate 100 may be flush with the outer widened portion 90 and in contact with the sealing element 92 (FIG. 2). In some embodiments, the air separator plate 100 is located on the side of the compressor 20. During assembly, the shroud bracket 28 can be fit over the fan 76 and the conduit 26 can be inserted into the bay 98. The air separator plate 100 can then be located against the shroud bracket 28 by inserting the conduit 26 through the slit portion 104 and into the aperture portion 106. The air separator plate 100 can then be connected to the should bracket 28 via the fasteners 108.

Figure 9:
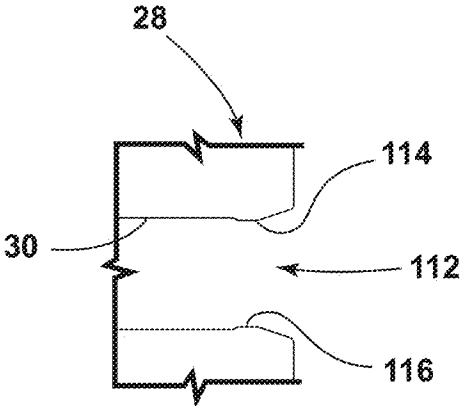
FIG. 9 is an enlarged plan side view of a shroud bracket in accordance with an aspect of the disclosure.
Figure 8:
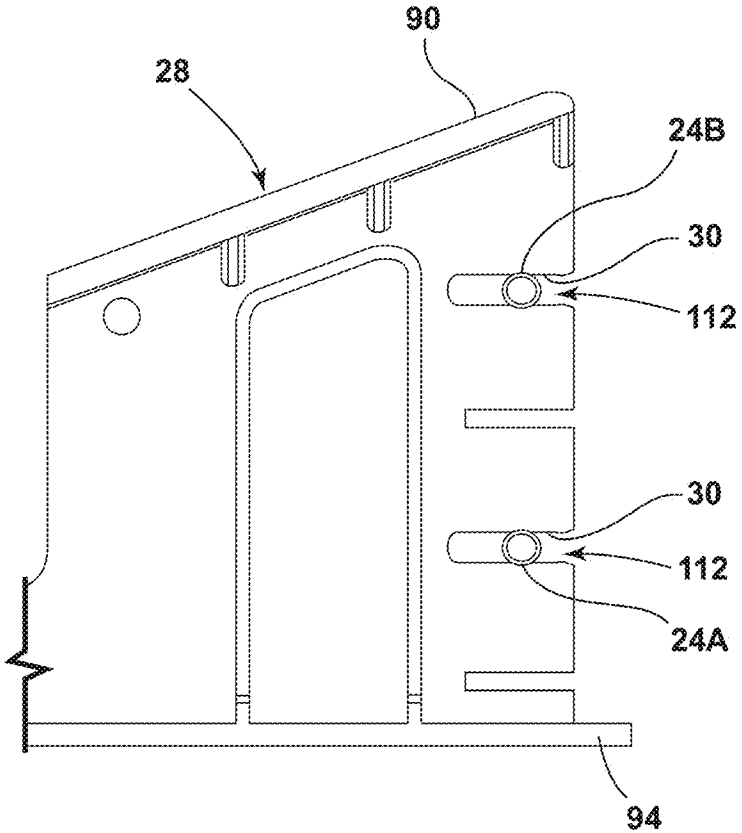
FIG. 8 is a plan side view of a shroud bracket in accordance with an aspect of the disclosure.

With reference now to FIGS. 8 and 9, the at least one slot 30 may include two or more slots 30 (e.g., a first and second slot) that are vertically spaced. Each slot 30 includes a port 112 for inserting the coolant tube 24A, 24B (e.g., the first cooling tube 24A connected to the first evaporator 16A or the second cooling tube 24B connected to the second evaporator 16B). Each port 112 defines an outward taper 114 to facilitate insertion of the coolant tube 24A, 24B. The outward taper 114 terminates at a collar portion 116 that retains the coolant tube 24A, 24B within the slot 30. More particularly, the slot 30 defines a width that is less than a width of the outward taper 114 but greater than a width of the collar portion 116 as indicated by the arrows in FIG. 9. In some embodiments, the coolant tube 24A, 24B includes a diameter than is equal to or greater than the collar portion 116. In this manner, the at least one coolant tube 24A, 24B is retained in the slot 30 by the collar portion 116. Each slot 30 may extend horizontally from a side perimeter of the shroud bracket 28. In this manner, the bay 98 may extend vertically from the top perimeter and each slot 30 may extend perpendicularly to the bay 98.

Figure 10:
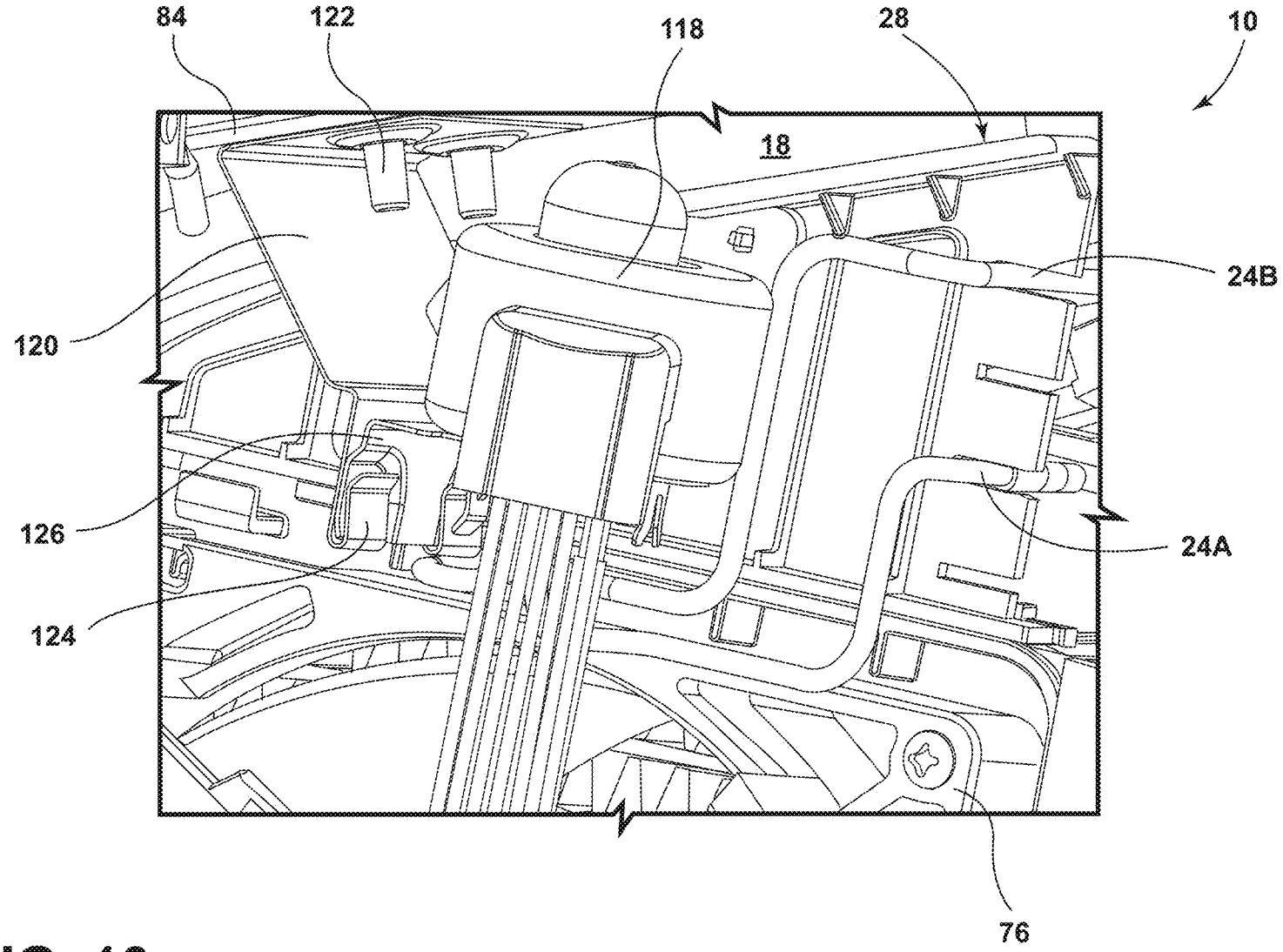
FIG. 10 is an upper perspective view of a three-way valve mounted within a compartment of a cooling appliance with a valve bracket in accordance with an aspect of the disclosure.

With reference now to FIG. 10, a three-way valve 118 is mounted to the interior of the compartment by a valve bracket 120, the valve bracket 120 may be connected to the interior of the compartment 18 (e.g., the interior sidewall 82 or interior ceiling 84) by mounting rods 122. The valve bracket 120 extends from the mounting rods 122 to a clip 124 (e.g., a pair of clips 124) that connects to an underside connection plate 126 of the three-way valve 118. The three-way valve 118 selectively facilitates a fluid connection between the first coolant tube 24A and/or the second coolant tube 24B to the cooling device 16A, 16B.

With reference now to FIGS. 1-10, the shroud bracket 28, the drain tube mount 34, and the valve bracket 120 facilitate the positioning and retaining of the coolant tubes 24A, 24B, the drainage routing tubes 31A, 31B, and the conduit 26, and the three-way valve 118. In this manner, the positioning of these components is maintained during assembly, shipping, handling during use, and operational vibrations of the cooling appliance 10. In addition, the components located in the compartment 18 are highly accessible during servicing and maintenance.

It should be appreciated that the location of the various components is illustrated in FIG. 1 as merely an example. For example, the location of the compressor 20 and condenser 22 may be switched as long at the direction of coolant flow through the cooling appliance 10, as indicated by arrows, remains functional.

The invention disclosed herein is further summarized in the following paragraphs and is further characterized by combinations of any and all of the various aspects described therein.

According to one aspect of the present disclosure, a cooling appliance includes a body defining a vacuum-insulated chamber. A cooling device is configured to regulate a temperature in the vacuum-insulated chamber. A partition is adjacent to the vacuum-insulated chamber and a compartment is spaced from the vacuum-insulated chamber by the partition. A compressor and a condenser are located in the compartment and at least one coolant tube is in fluid communication with the compressor and the condenser. A conduit provides power to and extends between the compressor, the condenser, and the cooling device. A shroud bracket is located between the compressor and the condenser and defines at least one slot that retains the at least one coolant tube.

According to another aspect of the disclosure, an at least one slot includes a port for inserting an at least one coolant tube and each port defines an outward taper to facilitate insertion of the at least one coolant tube.

According to another aspect of the disclosure, the outward taper terminates at a collar portion that retains the at least one coolant tube within the at least one slot.

According to another aspect of the disclosure, a shroud bracket defines a bay that retains a conduit.

According to another aspect of the disclosure, an air separator plate is connected to a shroud bracket over an outer perimeter of a bay.

According to another aspect of the disclosure, an air separator plate defines an opening smaller than a bay and a conduit extends through the opening.

According to another aspect of the disclosure, the opening includes a slit portion to facilitate insertion of the conduit and an aperture portion that retains the conduit.

According to another aspect of the disclosure, a shroud bracket is formed of a first material and an air separator plate is formed of a second material that is more flexible than the first material.

According to another aspect of the disclosure, a bay extends vertically from an upper perimeter surface of a shroud bracket and an at least one slot extends horizontally from a side perimeter surface of the shroud bracket.

According to another aspect of the disclosure, the vacuum-insulated chamber includes a freezer vacuum-insulated chamber and a refrigeration vacuum-insulated chamber and an at least one coolant tube includes a first coolant tube routed to a freezer vacuum-insulated chamber and a second coolant tube routed to a refrigeration vacuum-insulated chamber.

According to another aspect of the disclosure, the at least one slot includes a first slot and a second slot and the first coolant tube is located in the first slot and the second coolant tube is located in the second slot.

According to another aspect of the disclosure, each of the first and second slots extend horizontally and are vertically spaced.

According to yet another aspect of the present disclosure, a cooling appliance includes a body defining a vacuum-insulated chamber. A cooling device is configured to regulate a temperature in the vacuum-insulated chamber. A partition is adjacent to the vacuum-insulated chamber and a compartment is spaced from the vacuum-insulated chamber by the partition. A compressor and a condenser are located in the compartment and at least one coolant tube is in fluid communication with the compressor, the condenser, and the cooling device. A conduit provides power to and extends between the compressor and the condenser. A drainage routing tube extends from the cooling device to a drain tube mount and the drain tube mount includes a retention feature connected to a drainage receptacle.

According to another aspect of the disclosure, a drain tube mount includes a cup defining a top surface and a bottom surface, the cup includes a stepped region defining a retention feature.

According to another aspect of the disclosure, a retention feature includes a flange and at least one tab spaced from the flange.

According to another aspect of the disclosure, a drainage receptacle is located adjacent to a drain tube mount and defines an upwardly extending rim located between a flange and a at least one tab via press-fit engagement.

According to another aspect of the disclosure, a drainage release tube is in fluid communication with a drainage routing tube and defines a duckbill opening for releasing drainage into a drainage receptacle.

According to yet another aspect of the present disclosure, a cooling appliance includes a body defining a vacuum-insulated chamber. A cooling device is configured to regulate a temperature in the vacuum-insulated chamber. A partition is adjacent to the vacuum-insulated chamber and a compartment is spaced from the vacuum-insulated chamber by the partition. A compressor and a condenser are located in the compartment and at least one coolant tube is in fluid communication with the compressor, the condenser, and the cooling device. A conduit provides power to and extends between the compressor and the condenser. A shroud bracket is located between the compressor and the condenser and defines at least one slot that retains the at least one coolant tube. A drainage routing tube extends from the cooling device to a drain tube mount and the drain tube mount includes a retention feature connected to a drainage receptacle.

According to another aspect of the disclosure, a three-way valve is mounted to an interior surface of a compartment by a valve bracket, the valve bracket is connected to the interior surface of a compartment and extends to a clip that connects to an underside connection plate of the three-way valve.

According to another aspect of the disclosure, a valve bracket is connected to an interior ceiling of a compartment with connection rods.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, and the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A cooling appliance comprising:

a body defining a vacuum-insulated chamber;

a cooling device configured to regulate a temperature in the vacuum-insulated chamber;

a partition adjacent to the vacuum-insulated chamber;

a compartment spaced from the vacuum-insulated chamber by the partition;

a compressor and a condenser located in the compartment;

at least one coolant tube in fluid communication with the compressor, the condenser, and the cooling device;

a conduit providing power to and extending between the compressor and the condenser;

a shroud bracket located between the compressor and the condenser defining at least one slot that retains the at least one coolant tube and a bay that retains the conduit; and an air separator plate connected to the shroud bracket over an outer perimeter of the bay.

2. The cooling appliance of claim 1, wherein the at least one slot includes a port for inserting the at least one coolant tube and each port defines an outward taper to facilitate insertion of the at least one coolant tube.

3. The cooling appliance of claim 2, wherein the outward taper terminates at a collar portion that retains the at least one coolant tube within the at least one slot.

4. The cooling appliance of claim 1, wherein the air separator plate defines an opening smaller than the bay and the conduit extends through the opening.

5. The cooling appliance of claim 4, wherein the opening includes a slit portion to facilitate insertion of the conduit and an aperture portion that retains the conduit.

6. The cooling appliance of claim 5, wherein the shroud bracket is formed of a first material and the air separator plate is formed of a second material that is more flexible than the first material.

7. The cooling appliance of claim 1, wherein the bay extends vertically from an upper perimeter surface of the shroud bracket and the at least one slot extends horizontally from a side perimeter surface of the shroud bracket.

8. The cooling appliance of claim 1, wherein the vacuum-insulated chamber includes a freezer vacuum-insulated chamber and a refrigeration vacuum-insulated chamber and the at least one coolant tube includes a first coolant tube routed to the freezer vacuum-insulated chamber and a second coolant tube routed to the refrigeration vacuum-insulated chamber.

9. The cooling appliance of claim 8, wherein the at least one slot includes a first slot and a second slot and the first coolant tube is located in the first slot and the second coolant tube is located in the second slot.

10. The cooling appliance of claim 9, wherein each of the first and second slots extend horizontally and are vertically spaced.

11. A cooling appliance comprising:

a body defining a vacuum-insulated chamber;

a cooling device configured to regulate a temperature in the vacuum-insulated chamber;

a partition adjacent to the vacuum-insulated chamber;

a compartment spaced from the vacuum-insulated chamber by the partition;

a compressor and a condenser located in the compartment;

at least one coolant tube in fluid communication with the compressor, the condenser, and the cooling device;

a conduit providing power to and extending between the compressor and the condenser; and a drainage routing tube extending from the cooling device to a drain tube mount, the drain tube mount including a retention feature connected to a drainage receptacle and a cup defining a top surface and a bottom surface, the cup including a stepped region defining the retention feature.

12. The cooling appliance of claim 11, wherein the retention feature includes a flange and at least one tab spaced from the flange.

13. The cooling appliance of claim 12, wherein the drainage receptacle is located adjacent to the drain tube mount and defines an upwardly extending rim located between the flange and the at least one tab via press-fit engagement.

14. The cooling appliance of claim 11, wherein a drainage release tube is in fluid communication with the drainage routing tube and defines a duckbill opening for releasing drainage into the drainage receptacle.

15. A cooling appliance comprising:

a body defining a vacuum-insulated chamber;

a cooling device configured to regulate a temperature in the vacuum-insulated chamber;

a partition adjacent to the vacuum-insulated chamber;

a compartment spaced from the vacuum-insulated chamber by the partition;

a compressor and a condenser located in the compartment;

at least one coolant tube in fluid communication with the compressor, the condenser, and the cooling device;

a conduit providing power to and extending between the compressor and the condenser;

a shroud bracket located between the compressor and the condenser defining at least one slot that retains the at least one coolant tube;

a drainage routing tube extending from the cooling device to a drain tube mount, the drain tube mount including a retention feature connected to a drainage receptacle; and a three-way valve is mounted to an interior surface of the compartment by a valve bracket, the valve bracket is connected to the interior surface of the compartment and extends to a clip that connects to an underside connection plate of the three-way valve.

16. The cooling appliance of claim 15, wherein the valve bracket is connected to an interior ceiling of the compartment with connection rods.

* * * * *